United States Patent [19]

Nistri et al.

[11] Patent Number: 4,591,450

[45] Date of Patent: May 27, 1986

[54] PROCESS FOR THE PREPARATION OF A BLEACHING ACTIVATOR IN GRANULAR FORM

[75] Inventors: Ugo Nistri, Genoa; Romano Baroffio, Tradate; Paolo Colombo, Saronno, all of Italy

[73] Assignee: Mira Lanza S.p.A., Genoa, Italy

[21] Appl. No.: 680,951

[22] Filed: Dec. 11, 1984

[30] Foreign Application Priority Data

Mar. 22, 1984 [IT] Italy ..... 12470 A/84

[51] Int. Cl.[4] ..... C11D 7/16; C11D 7/54

[52] U.S. Cl. ..... 252/135; 252/99; 252/174.13; 252/91; 252/186.38

[58] Field of Search ..... 252/99, 135, 186.25, 252/186.38, 91, 174.13

[56] References Cited

U.S. PATENT DOCUMENTS

| | | | |
|---|---|---|---|
| 3,741,903 | 6/1973 | Evans | 252/95 |
| 3,789,002 | 1/1974 | Weber et al. | 252/99 |
| 4,290,903 | 9/1981 | Macgilp et al. | 252/91 |
| 4,333,844 | 6/1982 | Duggleby et al. | 252/97 |
| 4,372,868 | 2/1983 | Saran et al. | 252/102 |
| 4,417,994 | 11/1983 | Stoddard | 252/135 |
| 4,422,950 | 12/1983 | Kemper et al. | 252/186.38 |

FOREIGN PATENT DOCUMENTS

| | | |
|---|---|---|
| 1360427 | 7/1974 | United Kingdom . |
| 1381121 | 1/1975 | United Kingdom . |

*Primary Examiner*—Prince E. Willis

*Attorney, Agent, or Firm*—Spencer & Frank

[57] ABSTRACT

A process for the production of a bleaching activator in granular form, in which an aqueous suspension of acetylated bleach activator is filtered to recover a filtration cake comprised of the acetylated bleach activator and having a moisture content of from 20 to 65% by weight; from 1 to 7 parts by weight of the filtration cake of step (a) is mixed and granulated with 1 part by weight of sodium tripolyphosphate in a granulator means to provide a granulated product; and the granulated product is dried to a residual moisture content of from 5 to 15% by weight to obtain the bleaching activator.

11 Claims, 1 Drawing Figure

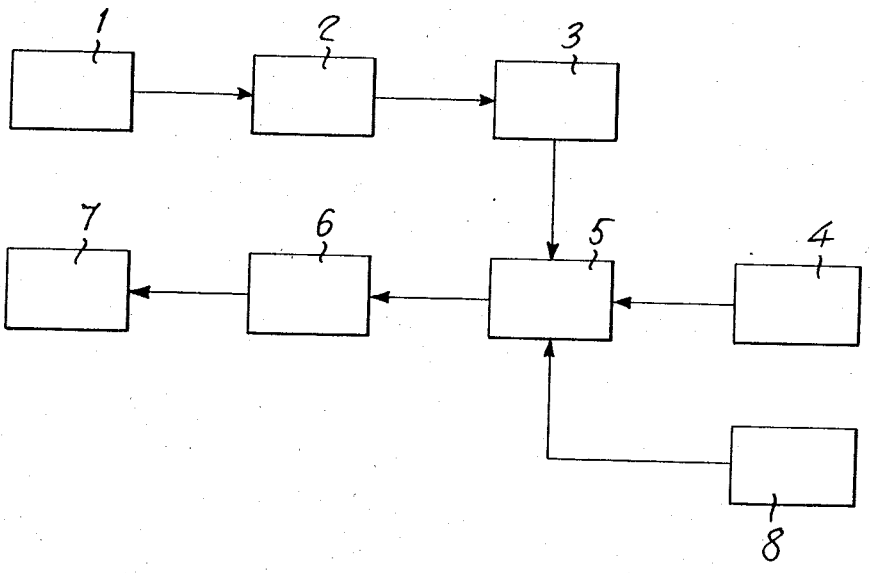
1
2
3
4
5
6
7
8

PROCESS FOR THE PREPARATION OF A BLEACHING ACTIVATOR IN GRANULAR FORM

BACKGROUND OF THE INVENTION

This invention relates to bleaching activators for use in detergent compositions, and more particularly to an improved process for the preparation of bleaching activators in granular form.

It is known that so called bleaching agents are among important components of the detergent compositions.

Usually, the bleaching agents are peroxides, and a typical peroxide used in detergent compositions is sodium perborate.

However, bleaching with peroxides is practical only within a certain temperature range (80°–85° C.) since at lower temperatures, as would be desirable from the standpoint of avoiding discoloration of the textiles washed, and the integrity of the fibres, as well as from the point of view of saving energy, the action of peroxides is too slow.

In order to make it possible to use the bleaching agents at lower temperatures, in the range of from 40° to 60° C., so called bleaching activators are added to the peroxide-containing detergent compositions.

The most used bleaching activators are the acetylation products of polyalcohols or polyamines, such as for instance, penta-acetylglucose (PAC), or tetra-acetylethylenediamine (TAED).

After completion of the acetylation reaction, the final products obtained, such as penta-acetylglucose or tetra-acetylethylenediamine are poured in water, in order to free them from the undesired reaction by-products, which are soluble in water. In this manner an aqueous suspension of PAC or TAED (which are water insoluble) is obtained which, after filtration, gives rise to a cake containing from about 30 to 65% water, depending on the filtration process used.

In the known technique, the thus obtained cake must be subjected to drying, and the dry activator powder must be coated with suitable protective compounds, before adding it to a detergent composition. The above entails many problems, among which the following are cited:

(a) The acetylated products are, as is well known, thermolabile compounds, with low m.p. so that they are degraded or also easily melted at the drying temperatures.

(b) During the granulation step, it is necessary to add a suitable binder, in order to secure the mechanical strength.

(c) During the granulation step it is necessary to again introduce water, which must be again eliminated in a subsequent drying operation.

All the above operations, besides affecting the cost of the final product and the length of the process, induce, due to the repeated thermal treatment operations, a more or less great degradation of same, which is particularly evidenced by the coloring of the product.

SUMMARY OF THE INVENTION

According to the invention, it has been discovered that it is possible to greatly simplify the production process of the granulate, at the same time reducing to a minimum the danger of thermal degradation of the active portion of the composition.

According to the invention this is achieved by mixing the wet product of the filtration cake directly with sodium tripolyphosphate in powder form in a suitable granulator, and by drying the thus obtained granulate.

Advantageously, the desiccation may already be partially obtained during the granulation process, by utilizing the heat from the exothermic hydration reaction of the tripolyphosphate and by exhausting the evaporated water by circulating an air stream through the granulator.

According to a further characteristic of the invention the ratio between the acetylated compound and the tripolyphosphate in the final product is advantageously between 7:1 and 1:1 by weight.

Moreover, the amount of water in the granulated product, before the final desiccation step, is advantageously between 25 and 35% by weight.

The starting filtration cake has a moisture content between 20 and 65% by weight, and preferably from 35 to 45% by weight.

The gain size of the final product is between 0.25 and 2 mm, preferably between 0.5 and 1.5 mm.

The specific gravity of the final product is between 0.5 and 0.9 g/ml and preferably between 0.6 and 0.8 g/ml.

The concentration of activator in the final granulate is between 30 and 90% by weight, and preferably between 50 and 70% by weight.

The residual humidity in the granulated product after final drying, is advantageously between 5 and 15% by weight, by maintaining unchanged the mechanical stability of the grains.

BRIEF DESCRIPTION OF THE DRAWING

Futher characteristics and advantages of the process according to the invention, will appear better from the following detailed description of one embodiment of same, shown by way of a non-limiting example, made with reference to the annexed drawing showing diagrammatically a production cycle of the granulate according to the invention.

DESCRIPTION OF THE PREFERRED EXAMPLE

With reference to the drawing, a tank 1 containing the aqueous suspension of an acetylated activator, which is, for example, a suspension of 25% by weight penta-acetylglucose, is shown. The suspension is fed to a continuous filter 2, thus obtaining a filtration cake 3, which, in the present example, has a moisture content of the 40% by weight. A suitable continuous granulator 5 is shown. Into the granulator 5 are fed continuously 500 Kg/hour of filtration cake 3, together with 167 Kg/hour of sodium tripolyphosphate from the reservoir 4. During the granulation in the granulator 5, evaporation of water takes place from the mixture being granulated due to the effect of the exhotermic hydration reaction of the tripolyphosphate, with consequent partial drying. In this step of the process, a wet granulate having the following composition by weight is obtained:

Penta-acetylglucose: 45%

Water: 30%

Tripolyphosphate: 25%

The thus produced granulate is fed continuously to a drier 6 in which the product is heated to a temperature comprised between 40° to 60° C., in air stream.

The composition of the granulate at the exit from the drier 6 has the following composition by weight:

Penta-acetylglucose: 58%

Water: 10%

Tripolyphosphate: 32%

The granulated dried product is stored in 7, for final utilization.

The physical characteristics of the final granulated product obtained according to the preceeding example, are the following:

| Apparent specific gravity<br>Grain size mm | 0.7 g/ml<br>% by weight |
|---|---|
| >2 | 0 |
| From 1.4 to 2.0 | 7 |
| from 0.5 to 1.4 | 56 |
| from 0.25 to 0.5 | 30 |
| from 0.15 to 0.25 | 6 |
| <0.15 | 1 |

If desired, it is possible to feed also special additives into the granulator 5 from a tank 8, as for instance, the usual additives used in the detergent industry, comprising also compounds which are apt to assist in the quick dissolution of the grains in the washing bath.

We claim:

1. A process for the production of a bleaching activator in granular form, said process comprising:

a. filtering an aqueous suspension of acetylated bleach activator to recover a filtration cake comprised of said acetylated bleach activator and having a moisture content of from 20 to 65% by weight;

b. mixing and granulating from 1 to 7 parts by weight of said filtration cake of step (a) with 1 part by weight of sodium tripolyphosphate in a granulator means to provide a granulated product; and c. drying said granulated product to a residual moisture content of from 5 to 15% by weight to obtain said bleaching activator.

2. The process according to claim 1, wherein the mixing and granulating step further includes circulating an air stream through said granulator means and exhausting water vapor therefrom, whereby a partial drying of said granulated product results which utilizes the internally generated heat from the exothermic hydration reaction of the tripolyphosphate.

3. The process according to claim 1, wherein said acetylated bleach activator is penta-acetyl glucose.

4. The process according to claim 1, wherein said granulated product obtained after said mixing and granulating step has a moisture content of from 25 to 35% by weight.

5. The process according to claim 1, wherein said bleaching activator is comprised of from 30 to 90% by weight of said acetylated bleach activator.

6. The process according to claim 1, wherein said bleaching activator has a specific gravity ranging from 0.5 to 0.9 g/ml.

7. The process according to claim 1, wherein said bleaching activator has a grain size ranging from 0.25 to 2.00 mm.

8. A bleaching activator for use in detergent compositions, obtained by the process according to claim 1.

9. The process according to claim 1, wherein said bleaching activator is comprised of from 50 to 70% by weight of said acetylated bleach activator.

10. The process according to claim 1, wherein said bleaching activator has a specific gravity ranging from 0.6 to 0.8 g/ml.

11. The process according to claim 1, wherein said bleaching activator has a grain size ranging from 0.5 to 1.5 mm.

* * * * *